US009907376B2

(12) United States Patent
Chatman et al.

(10) Patent No.: US 9,907,376 B2
(45) Date of Patent: Mar. 6, 2018

(54) BAG INTERIOR LIGHT EMITTING SYSTEM

(71) Applicants: Renee Chatman, Houston, TX (US); Lisa Heath, Houston, TX (US)

(72) Inventors: Renee Chatman, Houston, TX (US); Lisa Heath, Houston, TX (US)

( * ) Notice: Subject to any disclaimer, the term of this patent is extended or adjusted under 35 U.S.C. 154(b) by 28 days.

(21) Appl. No.: 15/077,263

(22) Filed: Mar. 22, 2016

(65) Prior Publication Data

US 2017/0273418 A1 Sep. 28, 2017

(51) Int. Cl.

| | |
|---|---|
| ***A45C 13/00*** | (2006.01) |
| ***A45C 13/08*** | (2006.01) |
| ***A45C 3/06*** | (2006.01) |
| ***A45C 13/26*** | (2006.01) |
| ***A47G 33/02*** | (2006.01) |

(52) U.S. Cl.

CPC ..... *A45C 13/08* (2013.01); *A45C 3/06* (2013.01); *A45C 13/001* (2013.01); *A45C 13/26* (2013.01); *A47G 33/02* (2013.01)

(58) Field of Classification Search

CPC ..... A45C 13/08; A45C 15/06; F21V 33/0008; F21W 2121/00; F21W 2121/002; F21W 2121/004; F21W 2121/006; F21W 2121/008; F21W 2121/02; F21W 2121/04; F21W 2121/06

See application file for complete search history.

(56) References Cited

U.S. PATENT DOCUMENTS

| | | | | |
|---|---|---|---|---|
| 3,609,342 | A | 9/1971 | Wisnlewski | |
| 5,018,057 | A * | 5/1991 | Biggs | A45C 15/06 362/156 |
| D332,150 | S | 12/1992 | Diorio | |
| 5,424,926 | A | 6/1995 | Myers | |
| 6,637,909 | B1 | 10/2003 | Bryan | |
| 7,207,689 | B2 | 4/2007 | Tait | |
| 8,147,086 | B2 | 4/2012 | Tait | |
| 8,451,251 | B2 * | 5/2013 | Choi | G06F 3/0412 178/18.09 |
| 9,605,839 | B2 * | 3/2017 | Tait | A45C 13/08 |
| 2005/0007765 | A1 | 1/2005 | Easley | |
| 2005/0047120 | A1 * | 3/2005 | Sargent | A45C 15/06 362/156 |
| 2005/0174758 | A1 | 8/2005 | Fields | |
| 2008/0013302 | A1 * | 1/2008 | Esses | A45C 15/06 362/99 |
| 2010/0182773 | A1 | 7/2010 | Wells | |
| 2011/0170282 | A1 | 7/2011 | Munoz | |
| 2015/0022099 | A1 * | 1/2015 | Farley | H05B 33/0857 315/161 |
| 2015/0101158 | A1 * | 4/2015 | Thomas | A44C 25/001 24/587.11 |
| 2016/0069553 | A1 * | 3/2016 | Schech | A45C 15/06 362/155 |

FOREIGN PATENT DOCUMENTS

| | | |
|---|---|---|
| WO | WO2005062853 | 7/2005 |

* cited by examiner

*Primary Examiner* — Robert May

(57) ABSTRACT

A light emitting system includes a bag that may contain items. A lighting unit is coupled to the bag and the lighting unit selectively illuminates the items thereby facilitating the items to be retrieved from the bag. The lighting unit is touch sensitive such that the lighting unit turns on when the lighting unit is touched. The lighting unit has a pair of intersecting arms such that the lighting unit has a cruciform shape.

6 Claims, 4 Drawing Sheets

BAG INTERIOR LIGHT EMITTING SYSTEM

BACKGROUND OF THE DISCLOSURE

Field of the Disclosure

The disclosure relates to light emitting devices and more particularly pertains to a new light emitting device for illuminating an interior of a bag.

SUMMARY OF THE DISCLOSURE

An embodiment of the disclosure meets the needs presented above by generally comprising a bag that may contain items. A lighting unit is coupled to the bag and the lighting unit selectively illuminates the items thereby facilitating the items to be retrieved from the bag. The lighting unit is touch sensitive such that the lighting unit turns on when the lighting unit is touched. The lighting unit has a pair of intersecting arms such that the lighting unit has a cruciform shape.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
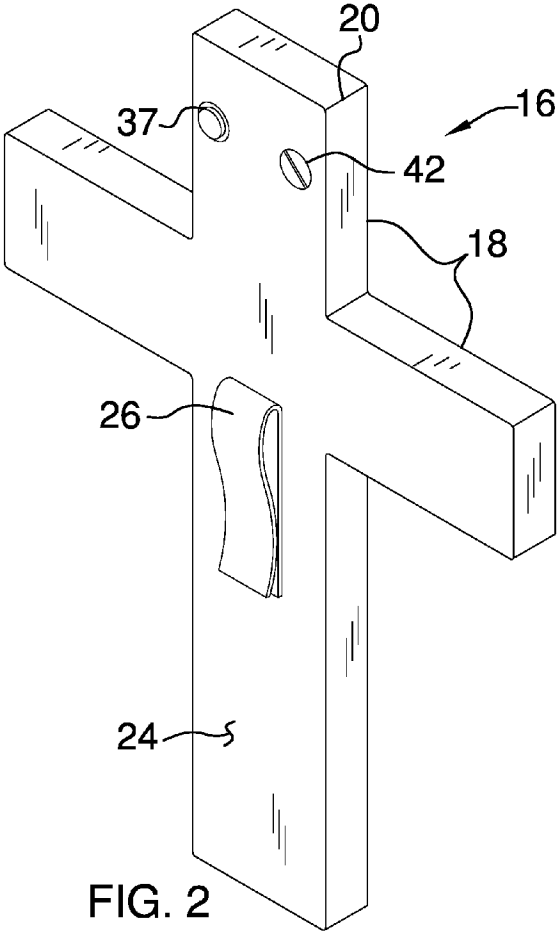
FIG. 2 is a back perspective view of an embodiment of the disclosure.
Figure 1:
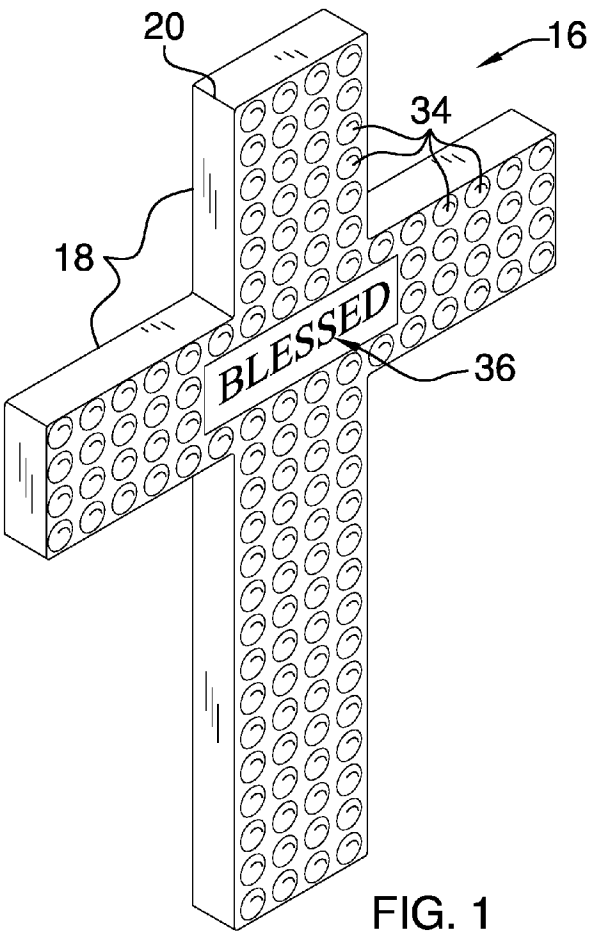
FIG. 1 is a front perspective view of a light emitting system according to an embodiment of the disclosure.
Figure 4:
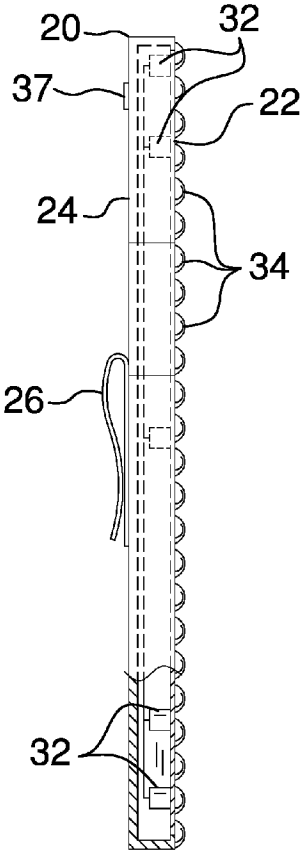
FIG. 4 is a cross sectional view taken along line 4-4 of FIG. 3 of an embodiment of the disclosure.
Figure 3:
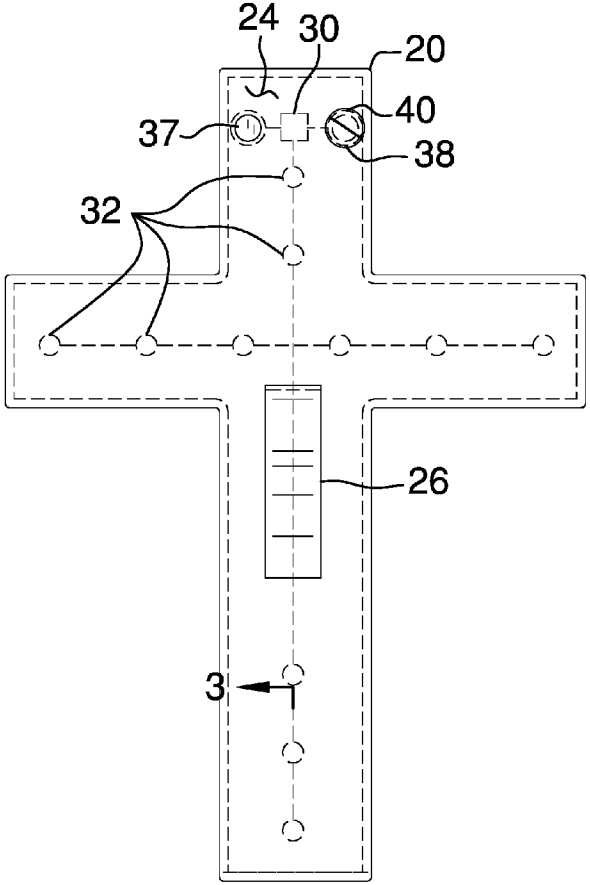
FIG. 3 is a back phantom view of an embodiment of the disclosure.
Figure 5:
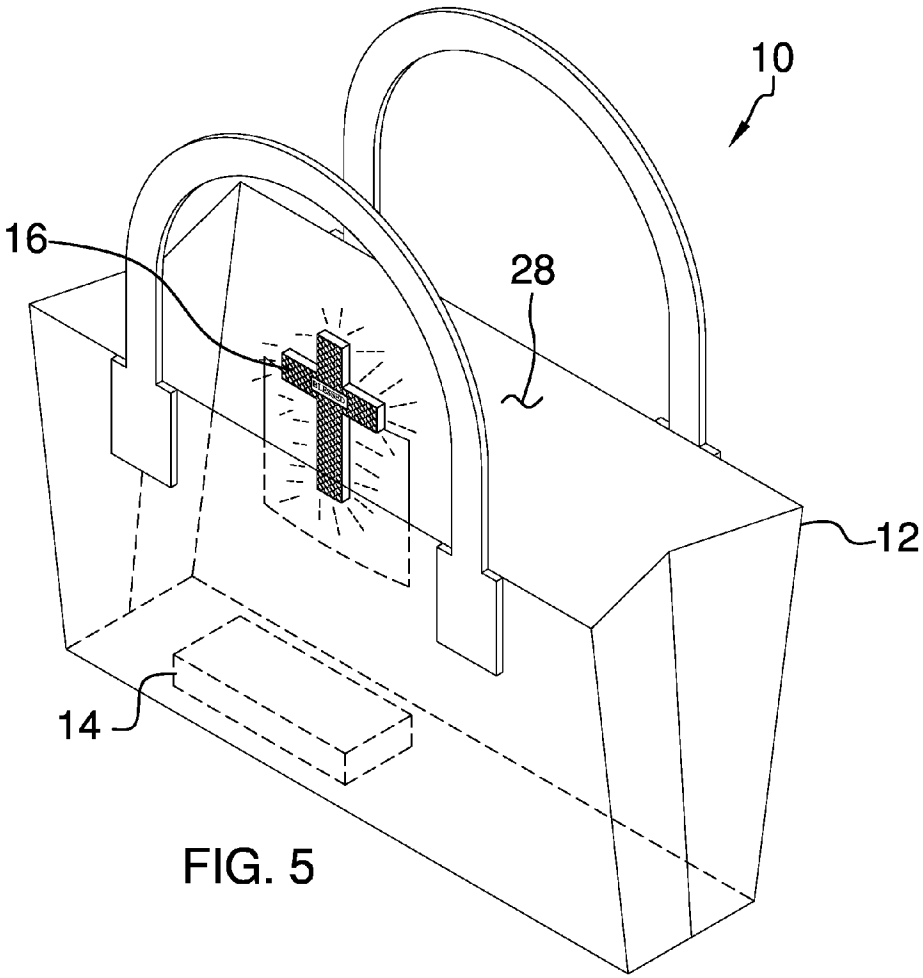
FIG. 5 is a phantom in-use view of an embodiment of the disclosure.

With reference now to the drawings, and in particular to FIGS. 1 through 6 thereof, a new light emitting device embodying the principles and concepts of an embodiment of the disclosure and generally designated by the reference numeral 10 will be described.

As best illustrated in FIGS. 1 through 6, the light emitting system 10 generally comprises a bag 12 that may contain items 14. The bag 121 may comprise a purse or the like. A lighting unit 16 is coupled to the bag 12. The lighting unit 16 selectively illuminates the items 14 thereby facilitating the items 14 to be retrieved from the bag 12. The lighting unit 16 is touch sensitive such that the lighting unit 16 turns on when the lighting unit 16 is touched. Additionally, the lighting unit 16 has a pair of intersecting arms 18 such that the lighting unit 16 has a cruciform shape. The lighting unit 16 may have a shape resembling various religious symbols or any other non-religious shape.

Figure 6:
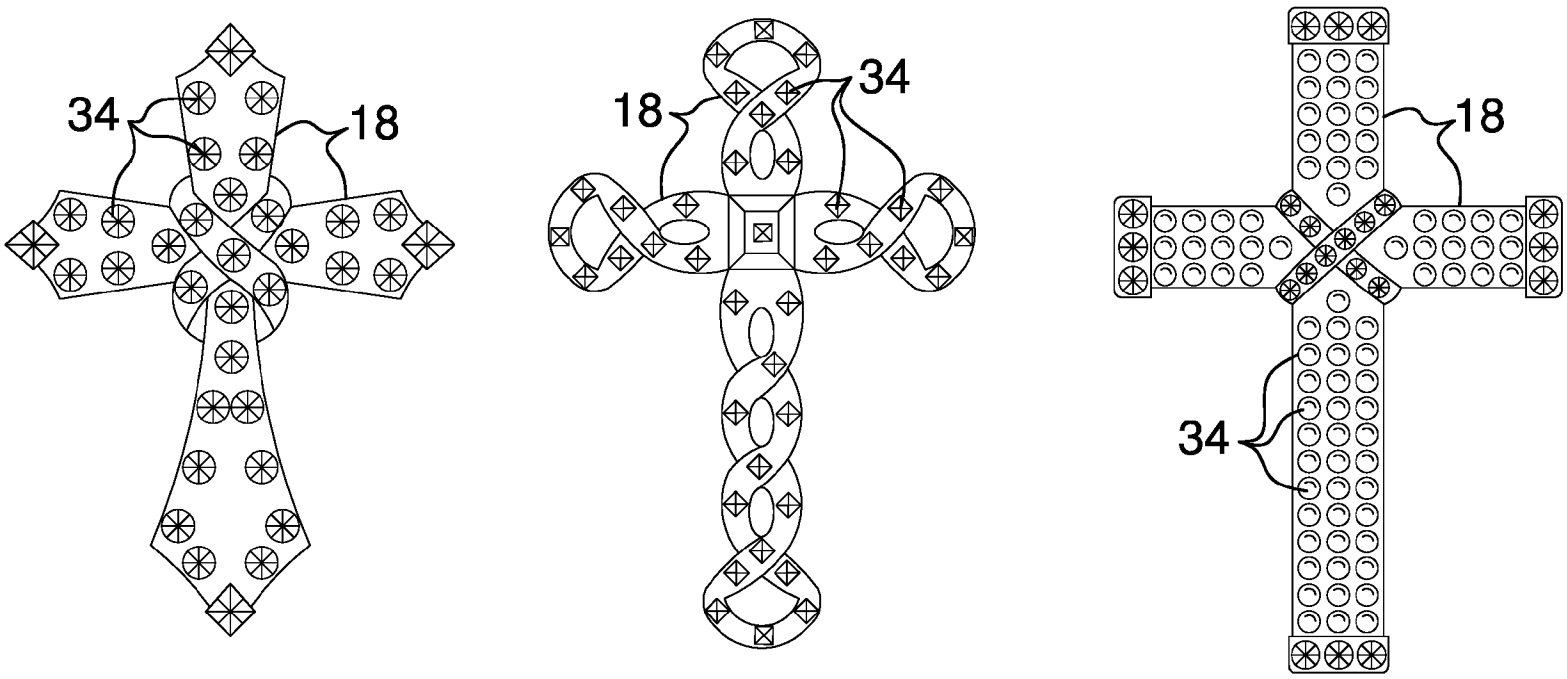
FIG. 6 is a front view of an alternative embodiment of the disclosure.

The lighting unit 16 comprises a housing 20 that includes the pair of intersecting arms 18. The intersecting arms 18 are oriented perpendicular to each other. Thus, the housing 20 has the cruciform shape. In an alternative embodiment as shown in FIG. 6, the housing 20 may be structured to represent various, ornamental cruciform designs. The housing 20 has a front surface 22 and a rear surface 24. A fastener 26 is coupled to the rear surface 24. The fastener 26 engages an inner surface 28 of the bag 12 such that the housing 20 is coupled to the bag 12. Thus, the front surface 22 of the housing 20 is exposed to an interior of the bag 12. The fastener 26 may comprise a clip or the other non-destructive, multiple use fastener.

A processor 30 is positioned within the housing 20 and the processor 30 may comprise an electronic processor or the like. A plurality of light emitters 32 is provided and each of the light emitters 32 is coupled to the front surface 22. The light emitters 32 are spaced apart from each other and distributed on each of the intersecting arms 18. Thus, each of the light emitters 32 may emit light outwardly from the front surface 22 thereby facilitating the items 14 to be located in the bag 12. Each of the light emitters 32 are electrically coupled to the processor 30.

Each of the light emitters 32 comprises a photodiode. Each of the light emitters 32 may detect light reflected from a finger when the finger touches the front surface 22. Thus, each of the light emitters 32 detects when the front surface 22 is touched. The processor 30 turns each of the light emitters 32 on when the front surface 22 is touched. Additionally, the processor turns 30 each of the light emitters 32 off after a pre-determined duration of time.

A plurality of decorations 34 is provided and each of the decorations 34 is coupled to the front surface 22 of the housing 20. Each of the decorations 34 enhances an ornamental appearance of the housing 20. The decorations may comprise jewels or the like. Indicia 36 may be printed on the front surface 22. The indicia 36 may comprise a word such as "Blessed" or other word(s) conveying an inspirational message.

A switch 37 is movably coupled to the rear surface 24 and the switch 37 may be manipulated. The switch 37 is electrically coupled to the processor 30 such that the switch 37 turns the light emitters 32 on and off. A power supply 38 is positioned in the housing 20 and the power supply 38 is electrically coupled to the processor 30. The power supply 38 comprises at least one battery 40. A battery cover 42 is removably coupled to the rear surface 24. The power supply 38 is positioned beneath the battery cover 42.

In use, the fastener 26 is coupled to the inner surface 28 of the bag 12 and the switch 37 is turned on. The front surface 22 of the housing 20 is touched to turn on the light emitters 32. The light emitters 32 illuminate the interior of the bag 12. Thus, a selected item 14 may be retrieved from the bag 12. The light emitters 32 turn off after the predetermined duration of time.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A light emitting system comprising:

a bag being configured to contain items; and a lighting unit being coupled to said bag wherein said lighting unit is configured to selectively illuminate the items thereby facilitating the items to be retrieved from said bag, said lighting unit being touch sensitive such that said lighting unit turns on when said lighting unit is touched, said lighting unit having a pair of intersecting arms such that said lighting unit has a cruciform shape, wherein said lighting unit comprises a housing comprising said pair of intersecting arms, said intersecting arms being oriented perpendicular to each other, said housing having a front surface and a rear surface, and a fastener being coupled to said rear surface, said fastener engaging an inner surface of said bag such that said housing is coupled to said bag having said front surface being exposed to an interior of said bag.

2. The system according to claim 1, further comprising:

a processor being positioned within said housing; and a plurality of light emitters, each of said light emitters being coupled to said front surface wherein each of said light emitters is configured to emit light outwardly from said front surface thereby facilitating the items to be located in said bag, each of said light emitters being electrically coupled to said processor, each of said light emitters comprising a photodiode wherein each of said light emitters is configured to detect touch, said processor turning each of said light emitters on when said light emitters is touched.

3. The system according to claim 2, wherein:

said housing has a rear surface; and a switch being movably coupled to said rear surface wherein said switch is configured to be manipulated, said switch being electrically coupled to said processor such that said switch turns said processor on and off.

4. The system according to claim 2, further comprising a power supply being positioned in said housing, said power supply being electrically coupled to said processor, said power supply comprising at least one battery.

5. The system according to claim 2, further comprising a plurality of decorations, each of said decorations being coupled to said front surface of said housing wherein each of said decorations is configured to enhance an ornamental appearance of said housing.

6. A light emitting system comprising:

a bag being configured to contain items; and a lighting unit being coupled to said bag wherein said lighting unit is configured to selectively illuminate the items thereby facilitating the items to be retrieved from said bag, said lighting unit being touch sensitive such that said lighting unit turns on when said lighting unit is touched, said lighting unit having a pair of intersecting arms such that said lighting unit has a cruciform shape, said lighting unit comprising:

a housing comprising said pair of intersecting arms, said intersecting arms being oriented perpendicular to each other, said housing having a front surface and a rear surface, a fastener being coupled to said rear surface, said fastener engaging an inner surface of said bag such that said housing is coupled to said bag having said front surface being exposed to an interior of said bag, a processor being positioned within said housing, a plurality of light emitters, each of said light emitters being coupled to said front surface wherein each of said light emitters is configured to emit light outwardly from said front surface thereby facilitating the items to be located in said bag, each of said light emitters being electrically coupled to said processor, each of said light emitters comprising a photodiode wherein each of said light emitters is configured to detect touch, said processor turning each of said light emitters on when said light emitters is touched, a plurality of decorations, each of said decorations being coupled to said front surface of said housing wherein each of said decorations is configured to enhance an ornamental appearance of said housing, a switch being movably coupled to said rear surface wherein said switch is configured to be manipulated, said switch being electrically coupled to said processor such that said switch turns said processor on and off, and a power supply being positioned in said housing, said power supply being electrically coupled to said processor, said power supply comprising at least one battery.

* * * * *